US008308156B2

(12) United States Patent
Shinohara

(10) Patent No.: US 8,308,156 B2
(45) Date of Patent: Nov. 13, 2012

(54) FEEDING MECHANISM FOR PRINTER

(75) Inventor: Masaaki Shinohara, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 165 days.

(21) Appl. No.: 12/591,063

(22) Filed: Nov. 6, 2009

(65) Prior Publication Data

US 2010/0117293 A1 May 13, 2010

(30) Foreign Application Priority Data

Nov. 10, 2008 (JP) ..... P2008-288206

(51) Int. Cl.
*B65H 29/32* (2006.01)

(52) U.S. Cl. ..... 271/196; 347/104

(58) Field of Classification Search ..... 271/272–274, 271/314, 196, 194, 197, 275–277, 264, 3.21–3.23; 347/104, 101
See application file for complete search history.

(56) References Cited

U.S. PATENT DOCUMENTS

| | | | | |
|---|---|---|---|---|
| 3,586,229 | A * | 6/1971 | Kamada et al. | 226/180 |
| 6,318,854 | B1 * | 11/2001 | Rasmussen et al. | 347/104 |
| 6,328,439 | B1 * | 12/2001 | Rhodes | 347/102 |
| 6,382,850 | B1 * | 5/2002 | Freund et al. | 400/118.2 |
| 6,497,522 | B2 * | 12/2002 | Wotton et al. | 400/578 |
| 6,575,459 | B1 * | 6/2003 | Kakiwaki et al. | 271/242 |
| 2002/0158410 | A1 * | 10/2002 | Dolz et al. | 271/276 |
| 2006/0187289 | A1 * | 8/2006 | Nakashima | 347/104 |
| 2007/0103534 | A1 * | 5/2007 | Shinohara et al. | 347/104 |
| 2009/0072476 | A1 * | 3/2009 | Inoue et al. | 271/273 |
| 2009/0256896 | A1 * | 10/2009 | Scarlata | 347/101 |

FOREIGN PATENT DOCUMENTS

| | | |
|---|---|---|
| JP | 09-058897 | 3/1997 |
| JP | 2006-137027 | 6/2006 |

* cited by examiner

*Primary Examiner* — Gerald McClain
*Assistant Examiner* — Thomas Morrison
(74) *Attorney, Agent, or Firm* — Nath, Goldberg & Meyer; Jerald L. Meyer; Robert T. Burns

(57) ABSTRACT

A feeding apparatus for print media comprises a pressure roller that is provided at an upstream side of an image forming section in a feeding direction of the print media and rotates with being pressed onto an upper surface of a feeding path. The pressure roller includes a plurality of unit rollers aligned along a primary sweeping direction perpendicular to the feeding direction. A center unit roller of the unit rollers is made wider than other unit rollers in the primary sweeping direction. According to the apparatus, cocklings on print media can be removed at desired portions with a simple configuration by controlling suction forces due to varying relative positions to suction ports. Therefore, flatten state of print media in the image forming section can be easily ensured.

4 Claims, 14 Drawing Sheets

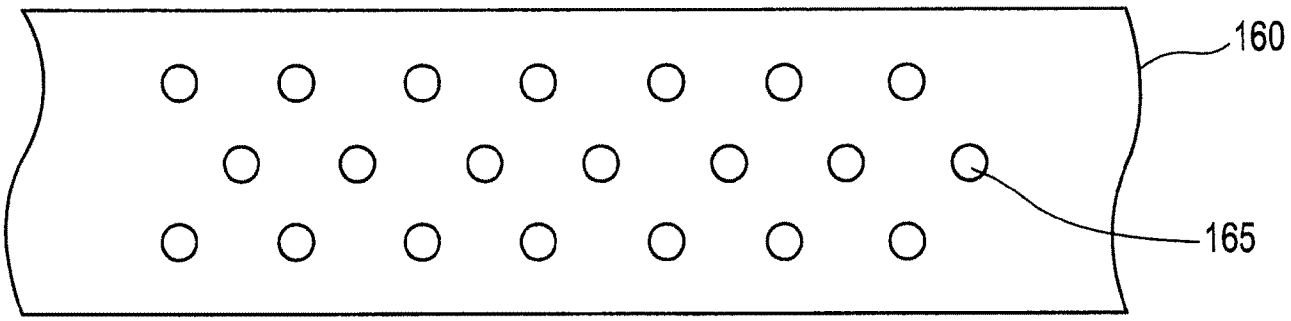
FIG. 7
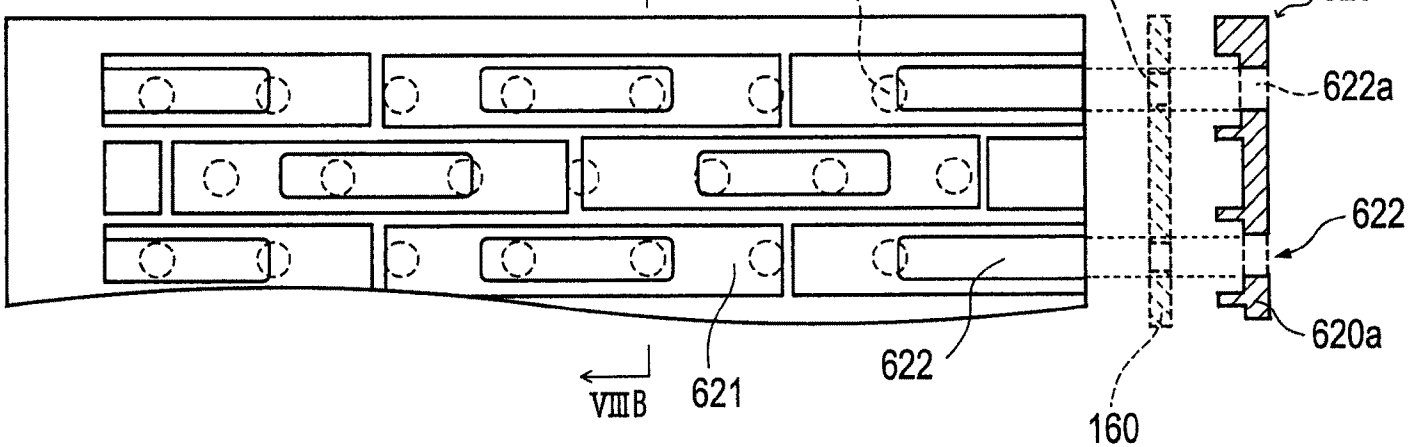
FIG. 8B
FIG. 8A

FEEDING MECHANISM FOR PRINTER

BACKGROUND OF THE INVENTION

1. Field of the Invention

The present invention relates to a feeding mechanism of print media for a printer, which forms an image by injecting ink drops from its image forming unit onto print media fed on a feeding path.

2. Description of Related Art

In an inkjet printer, it is needed to remove wrinkles and wavings (also called as cocklings, hereinafter) on print media on injecting inks onto the print media and to keep a distance between each surface of the print media and ink heads for stable printing. In addition, it is also needed to remove uplifts of print media with initially affected with humidity.

Recently, in order to improve printing speed, proposed is a line head inkjet printer, in which print heads are aligned along a whole width of print media. In many cases, a line head of such a printer is bade by aligning plural print heads each has a smaller width than the width of print media along a width direction of print media.

Therefore, in such a line head inkjet printer, cocklings tend to occur due to moisture absorption of printing papers and ink attaching onto print media. As a result, degradation of image quality or the like may be brought. Then, it is needed to keep a distance between each surface of the print media and ink heads.

A so-called air suction type print media feeding mechanism for solving the above issues is well-known and one is disclosed in Japanese Patent Application Laid-Open No. H9-58897 (Patent Document 1). In the mechanism disclosed in the Patent Document 1, two or more roller are provided at some intervals and a porosity endless belt that is wider than print media is held and rotated by the rollers. In addition, air is suctioned through holes formed on the belt due to negative pressure under the belt in order to flatten the print media on the belt.

Another type of print media feeding mechanisms for solving the above issues is disclosed in Japanese Patent Application Laid-Open No. 2006-137027 (Patent Document 2). In the mechanism disclosed in the Patent Document 2, press rollers for pressing print media are provided to flatten the print media. The press rollers are aligned along a feeding direction and located at an upstream and a downstream of print heads. Each press rollers is urged toward a feeding path in an image forming section to flatten the print media just beneath the print heads.

SUMMARY OF THE INVENTION

However, according to the air suction type print media feeding mechanism disclosed in the Patent Document 1, its suction forces generated by a fan apply to print media only when suction holes formed on the belt are coincident with suction holes formed on a plate for supporting the belt. Therefore, the suction forces apply locally, so that positional disparity occurs and pulsation of airflow occurs. As a result, desired stable suction forces cannot be brought.

According to the print media feeding mechanism with the press rollers disclosed in the Patent Document 2, uplifts and wet cocklings of print media can be prevented on injecting inks. However, it is not considered to use the mechanism disclosed in Patent Document 2 together with the air suction method disclosed in Patent Document 1. Therefore, when trying to smooth away wrinkles on print media using the press rollers, smoothing cannot be done effectively due to suctioning through the suction holes. As a result, it cannot be surely achieved to flatten print media just beneath print heads.

The present invention has been achieved in order to solve the above problems and an object of the present invention is to provide a feeding apparatus for print media that can restrict cocklings on print media with a simple configuration and remove wet cocklings on print media at desired portions by controlling suction forces due to varying relative positions to suction ports to flatten print media just beneath ink heads.

An aspect of the present invention provides a feeding apparatus for print media in a printer, which forms images at an image forming section by injecting inks on the print media being fed on a feeding path. The apparatus comprises a pressure roller that is provided at an upstream side of the image forming section in a feeding direction of the print media and rotates with being pressed onto an upper surface of the feeding path. The pressure roller includes a plurality of unit rollers aligned along a primary sweeping direction perpendicular to the feeding direction. A center unit roller of the unit rollers is made wider in the primary sweeping direction than other unit rollers.

According to the aspect of the present invention, the pressure roller is pressed onto upper surfaces of print media on feeding the print media toward the image forming section to restrict uplifts of the print media. Especially, since the unit rollers are provided along a primary sweeping direction perpendicular to the feeding direction and the center unit roller is made wider than the other unit rollers, wrinkles on print media due to uplifts of the print media can be smoothed away so as to extend away the wrinkles from the center of the print media toward both sides of the print media. As a result, cocklings at whole areas of the print media can be prevented.

It is preferable that the plurality of unit rollers is aligned in a V-shape arrangement that is opened toward a downstream of the feeding direction.

According to the above configuration, print media are sequentially pressed by the unit rollers from its center toward its both sides as they are fed from the upstream to the downstream. Therefore, pressed portions by the unit rollers are shift toward the both sides of the print media as feeding the print media. As a result, wrinkles on the print media can be smoothed away toward the both sides of the print media.

It is preferable that the apparatus further comprises a platen belt on which a number of belt holes are formed for suctioning the print media therethrough. Note that the platen belt is slid within a range opposing the image forming section to feed the print media. In addition, the unit rollers are located at positions associated with the belt holes.

According to the above configuration, since the unit rollers are located at the positions associated with the belt holes formed on the platen belt, pressing by the unit rollers and suctioning through the recesses can be done concurrently at the same position. Therefore, uplifts or wrinkles of the print media that could not settled by the unit rollers can be surely smoothed by suctioning through the recesses. As a result, rumplings of the print media can be completely smoothed away.

It is preferable that the apparatus further comprises a platen belt on which a number of belt holes are formed for suctioning the print media therethrough (the platen belt is slid within a range opposing the image forming section to feed the print media), a suction unit for generating negative pressure to suction the print media on an upper surface of the platen belt through the belt holes, and a chamber partitioner for surrounding a suctioned airflow path from the suction unit to the belt holes under an airtight state. Here, the chamber partitioner includes an inclined wall downwardly-inclined at an upstream end thereof, and the pressure roller is located near the upstream end of the inclined wall.

According to the above configuration, since the chamber partitioner surrounds the suctioned airflow path from the suction unit to the belt holes under an airtight state and includes the inclined wall downwardly-inclined at its upstream end, suction forces applied to print media are made gradually stronger from the upstream to the downstream. In addition, since the pressure roller is provided near the upstream end of the inclined wall and the center unit roller is made wider than the other unit rollers that aligned at both side in the width direction, smoothing wrinkles by the pressure roller is started at a position where suctioning on the platen belt is started. Therefore, cocklings of the print media can be surely prevented without applying excessive loads onto the print media.

Especially, if the unit rollers of the pressure roller are aligned in a V-shape arrangement that is opened toward the downstream of the feeding direction, smoothing toward the both sides of the print media can be made gradually alleviated along with gradual increase of the suction forces from the upstream to the downstream. Therefore, pressing forces by the unit rollers and suction forces by the suction unit can be well-balanced. As a result, removing of cocklings can be averaged throughout from the upstream to the downstream.

It is preferable that the apparatus further comprises a platen plate for slidably supporting an upper segment of the platen belt at the range opposing the image forming section, and a plurality of suction holes formed on the platen plate at positions associated with the belt holes. Here, the suction holes are enlarged toward an upper surface of the platen plate to form recesses, respectively, and the unit rollers are located at positions associated with the recesses.

According to this configuration, suction forces through the suction holes can be decentrally applied to the insides of the recesses by enlarging the suction holes. Therefore, disparity between pressing forces of the unit rollers and suction forces through the recesses can be reduced and local loads applying to the print media can be alleviated. As a result, rumplings of the print media can be completely smoothed away.

BRIEF DESCRIPTION OF THE DRAWINGS

FIG. 7 is a plan view showing a platen belt in the embodiment;

FIG. 8A is a plan view showing an upper platen plate in the embodiment;

FIG. 8B is a cross-sectional view taken along a line VIIIB-VIIIB shown in FIG. 8A;

DETAILED DESCRIPTION OF THE EMBODIMENTS

General Configuration of Printer

Figure 1A:
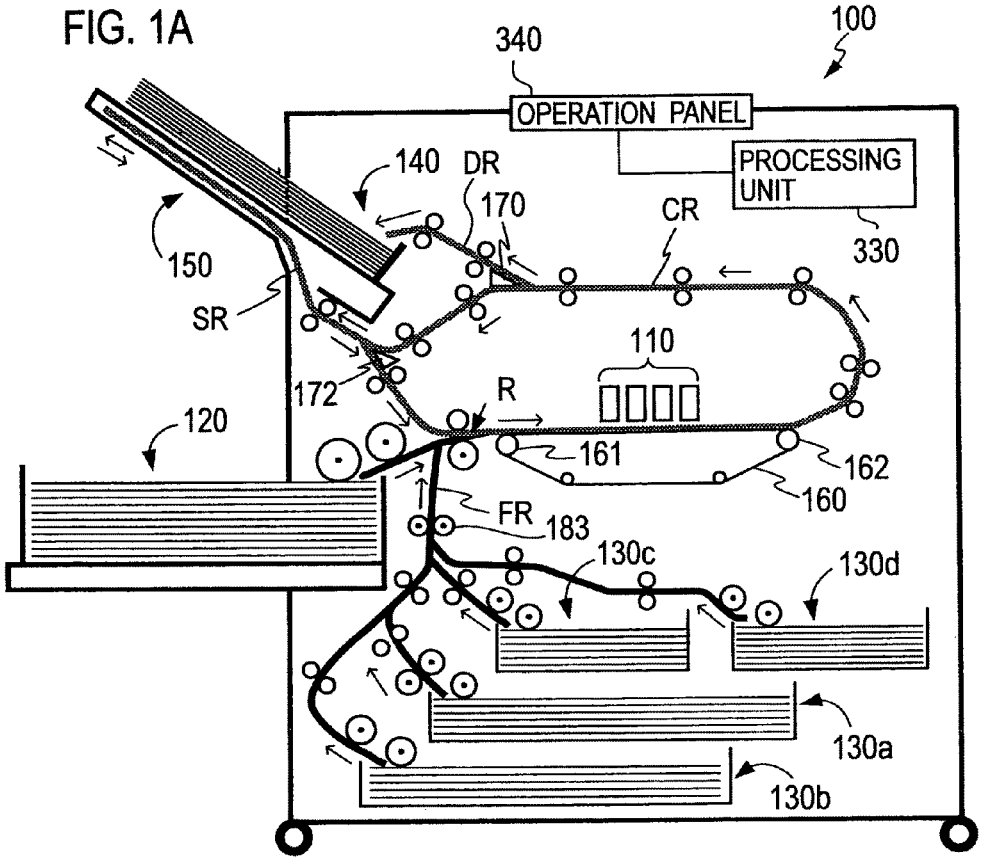
FIG. 1A is a configuration diagram showing a general outline of a feeding path of print media in a printer with a feeding mechanism according to an embodiment of the present invention.

One embodiment of an image forming apparatus according to the present invention will be explained hereinafter. As shown in FIG. 1A, a printer 100 (the image forming apparatus) is an inkjet type color line printer. The printer 100 includes a plurality of ink heads 110*a* (head units 110) each has a number of nozzles. Printing is done line by line by ejecting black and/or color ink drops from the nozzles onto print media on a feeding belt so as to overlap images each other.

The printer 100 is an apparatus for forming images on each surface of print media fed along a circular feeding path. The image forming path is mainly composed of sheet feed paths FR for supplying print media, a main path CR extending from the sheet feed paths FR to a paper ejection path DR via head units 110, and a reversing path SR branched from the main path CR.

On the sheet feed paths FR, a sheet feed side shelf 120 provided outside of a cabinet and sheet feed trays 130 (130*a* to 130*d*) provided within the cabinet are equipped as a media feed mechanism for feeding print media. A paper ejection port 140 is provided as a sheet ejection mechanism for ejecting printed print media.

Print media, which are supplied from the sheet feed side shelf 120 or the sheet feed trays 130, are fed along the sheet feed path FR within the cabinet by a drive mechanism such as rollers and led to a registry position R which is a reference position for each leading edge of the print media. The head units 110 each having a printing head are provided at a downstream portion from the registry position R in a feeding direction. Images are formed line by line on the print media due to inks injected from the ink heads 110*a* while the print media are fed by a platen belt (feed belt) 160 provided oppositely to the head units 110 with a speed that is set according to a printing condition.

The printed print media are further fed along the main path CR by the drive mechanism such as rollers. In a case of one-side printing for printing on only one surface of the print media, the print media are ejected from the paper ejection port 140 via the ejection path DR and stacked on an ejected paper tray 150 provided as a receiving shelf with its printed surface being down-faced. The ejected paper tray 150 has a tray shape extending outward from the cabinet and has some degrees of thickness. The ejected paper tray 150 is inclined and ejected print media are aligned spontaneously to be stacked due to a wall formed at the lowest position of the inclined ejected paper tray 150.

On the other hand, in a case of double-side printing for printing on both surfaces of the print media, the print media are not led to the ejection path DR after printing on a front surface (a firstly printed surface is defined as a "front surface" and a next printed surface is defined as a "back surface") and fed further within the cabinet to the reversing path SR. The printer 100 includes a reversing mechanism 170 to change over feed paths for a reverse printing. The print media that were not fed to the ejection path DR due to the reversing mechanism 170 are drawn to the reversing path SR.

By the reversing path SR, the print media are reversed while the print media are received from the main path CR by feeding back and forth. This operation is so-called a switch-back. Subsequently, the print media are returned to the main path CR by the drive mechanism such as rollers via a switch-over mechanism 172 and fed again from the registry position R for printing on the back surface by the same processes as printing on the front surface. After printing on the back surface, the print media with images being printed on their both surfaces are led to the paper ejection port 140 via the ejection path DR and ejected onto the ejected paper tray 150 provided as the receiving shelf of the paper ejection port 140. The ejected print media are stacked on the ejected paper tray 150.

Note that, in the present embodiment, the switchback in the double-side printing is done using a space within the ejected paper tray 150. The space within the ejected paper tray 150 is configured to be covered for preventing the print media from being brought out during the switchback. This configuration prevents the print media being reversed from being drawn away accidentally by a user. In addition, since the ejected paper tray 150 is inherently provided on the printer 100, it is not needed to provide a special independent space for the switchback within the printer 100 due to the efficient use of the space within the ejected paper tray 150 for the switchback. Further, since the ejection path DR and the reversing path SR are not shared, the switchback operation and the paper ejection of the print media can be done in parallel.

During double-side printing in the printer 100, the print media that have been already printed on its one surface are fed from the reversing path SR to the registry position R of the reference position for each leading edge of fed print media. Therefore, a confluent point C at which the sheet feed paths FR for newly fed print media and a re-feed path for recirculated print media to be printed on its back surface is formed at just upstream the registry position R. Print media are fed from the registry position R in vicinity of the confluent point C of the sheet feed paths FR and the main path CR toward an image forming section.

Figure 1B:
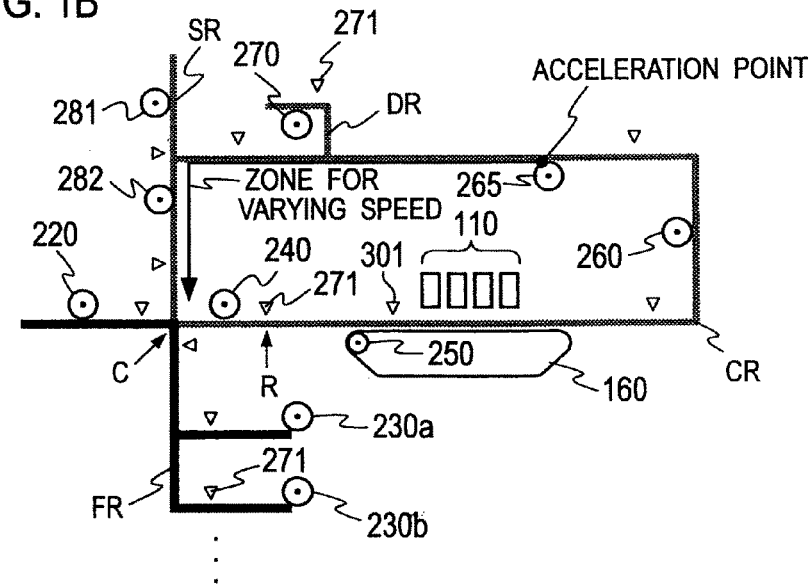
FIG. 1B is a schematic diagram showing sheet feed paths FR, a main path CR and a reversing path SR in the embodiment.

In the present embodiment, when the confluent point C is defined as a reference point, paths located in the side of the media feed mechanism are defined as the sheet feed paths FR. In addition, a path located in the side of the sheet ejection mechanism is defined as the ejection path DR. Further, a path other than the sheet feed paths FR and the ejection path DR is defined as the feeding path. The feeding path is circular and includes the main path CR and the reversing path SR as mentioned above. FIG. 1B schematically shows the main path CR and the reversing path SR. Note that some of the rollers that compose the drive mechanism are omitted to be drawn in the FIG. 1B, so that the number of the rollers in FIG. 1B is not necessarily accurate.

On the sheet feed paths FR, equipped are a side sheet feed drive unit 220 for feeding print media from the sheet feed side shelf 120 and tray drive units 230*a*, 230*b* . . . for feeding print media from the sheet feed trays 130 (130*a* to 130*d*). A sheet feed unit for feeding print media to the registry position R is composed of these components.

Further, any of the tray drive units 230*a*, 230*b* . . . on the sheet feed paths FR also includes a drive mechanism composed of rollers or the like and draws print media one by one from print media stacked on the sheet feed side shelf 120 or the sheet feed trays 130 to feed the print media toward the registry position R. Each of the drive units can be driven independently according to the media feed mechanism that is going to feed print media.

Figure 2:
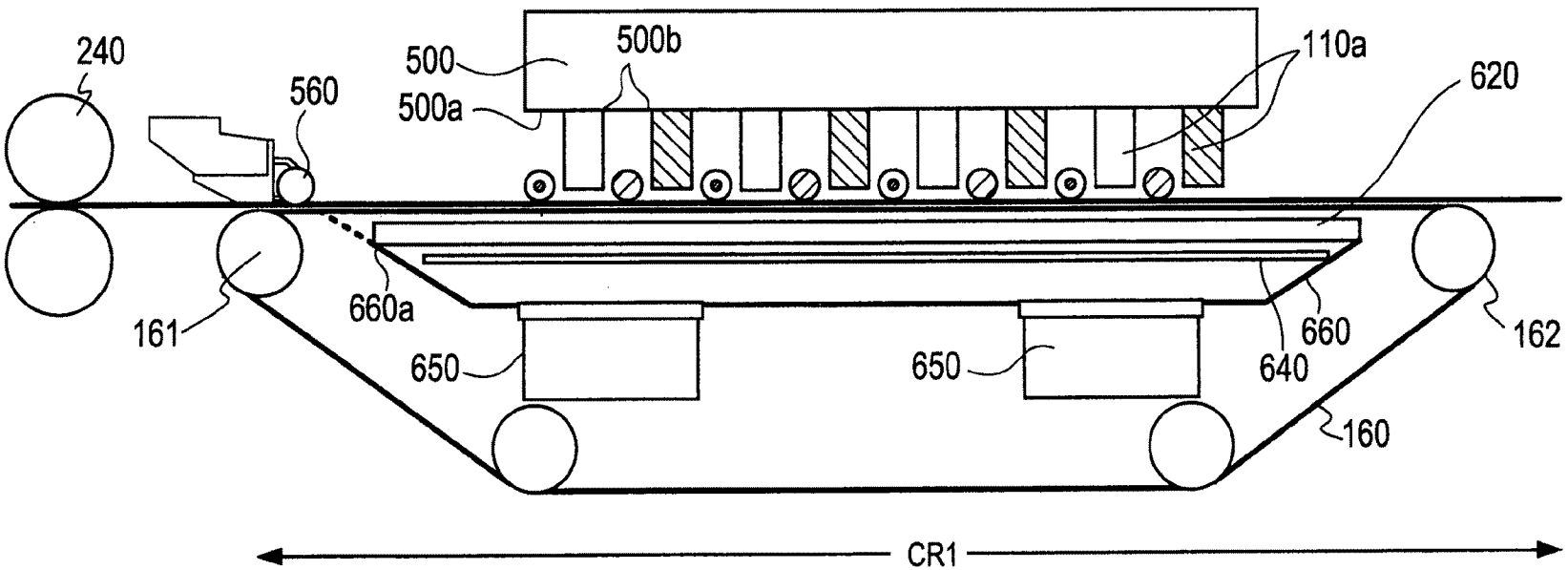
FIG. 2 is a schematic diagram showing an image forming path from its side in the embodiment.

As shown in FIG. 2, plural feed sensors 271 are provided on the sheet feed paths FR to detect sheet jams on the sheet feed paths FR. Namely, each of the feed sensor 271 is a sensor for detect absence or presence of print media or to detect each leading edge of print media. For example, the feed sensors 271 are provided at appropriate intervals on the feeding path and it is determined that a sheet jam occurs when a print medium is not detected by a downstream sensor 271 within a predetermined duration time from the time of detecting the print medium by an upstream feed sensor 271.

A registry sensor 271, which is one of these feed sensors 271, is located at the registry position R from which print media are fed out (or, at just before the registry position R). The registry sensor 271 also measures each size of print media being fed. For example, the registry sensor 271 measures a size of a print medium passing through based on its passing velocity and its passing time. The registry sensor 271 can determine that a sheet jam (a feed error) occurs when no print medium is detected by a feed sensor 271 within a predetermined duration time from the time of starting to drive the side sheet feed drive unit 220 or the tray drive units 230*a*, 230*b* and so on.

The main path CR composes a part of a circular feeding path. The main path CR is a path from the sheet feed paths FR for feeding print media to the ejection path DR via the head units 110. Images are formed on each upper surface of print media within the main path CR. On the main path CR, a registry drive unit 240 for feed print media to the registry position R, a belt drive unit 250 for endlessly driving the platen belt 160 provided oppositely against the head units 110, first and second upper feed units 260 and 265 provided in sequence along a feeding direction, an upper ejection drive unit 270 for leading printed print media to the ejection port 140, and a drive unit for drawing print media into the reversing path SR. Each of the drive units can be driven independently according to feeding conditions of print media.

Further, plural feed sensors 271 are provided on the main path CR to detect sheet jams on the main path CR. Furthermore, proper feedings of print media can be confirmed at the registry position R. On the main path CR, the feed sensors 271 are provided with being associated with the drive units, respectively. Therefore, it can be specified that a sheet jam occurs at which drive unit on the main path CR.

The reversing path SR is connected to the main path CR with being branched. The reversing path SR is a path and a feed mechanism for receiving print media from the main path CR and bringing back the print media to the main path CR after reversing the print media by feeding back and forth (by the switchback). On the reversing path SR, equipped is a reverse drive unit 281 for leading print media to the confluent point C after reversing the print media. In addition, feeding on the reversing path SR can be done with a different speed from a speed on the main path CR. Therefore, a feeding speed on the reversing path SR can be accelerated or decelerated when print media are drawn from the main path CR. Further, a detention time at the switchback can be prolonged or shortened by controlling the feeding speed on the reversing path SR.

In the present embodiment, after feeding a leading print medium, next feeding of another following print medium is started not after the ejection of the print medium that has been printed but before the ejection of the print medium due to scheduling. Therefore, printing can be done successively at predetermined time intervals. Under a normal for double-side printing, a space is preliminarily secured for a print medium to be brought back from the reversing path SR when feeding a print medium to be printed on its front surface. According to the printer 100 in the present embodiment, printing for a front surface and printing for a back surface can be processed in parallel and thereby efficiency can be improved twice as much as one-side printing.

The platen belt 160 is placed around a drive roller 161 and a driven roller 162. The drive roller 161 is provided at a front end of a plane opposed with the head units 110 and the driven roller 162 is provided at a rear end of the plane. The platen belt 160 rotates clockwise in FIGS. 1A and 1B. The four-color ink heads 110*a* (head units 110) are provided above an upper plane of the platen belt 160 along a moving direction of the platen belt 160 so as to form a color image by overlapping images each formed by the respective head units 110.

In addition, the printer includes an arithmetic processing unit 330 as shown in FIG. 1A. The processing unit 330 is a processing module composed of processors such as a CPU, a DSP (Digital Signal Processor) and so on, memories, other hardwares such as electronic circuits, softwares such as programs implementing functions of the above-mentioned components, or combinations thereof. The processing unit 330 virtually builds various functional modules by arbitrarily loading and executing programs. The processing unit 330 also executes processes of image data, controls of components' operations and various processes against user's operations using the built functional modules. Further, an operation panel 340 is connected to the processing unit 330. User's, instructions and setting operations can be accepted via the operation panel 340.

(Feed Mechanism on Image Forming Path)

As shown in FIG. 2, the main path CR includes an image forming path CR1 composed of the platen belt 160, the drive roller 161, the driven roller 162 and so on. A head holder 500 is provides above the image forming path CR1. The head holder 500 is a case having a head holder surface 500*a* at its bottom face and composes the image forming section. The head holder 500 holds/fixes the ink heads 110*a* and unitizes other components for injecting inks from the ink heads 110*a* to house them therein.

The head holder surface 500*a* is arranged oppositely and parallely to the feed path. Attachment openings 500*b* each has the same shape as a horizontal cross-sectional shape of the ink heads 110*a* are arrayed on the head holder surface 500*a*. The ink heads 110*a* are inserted into the attachment openings 500*b*, respectively, and project their injection ports from the attachment openings 500*b* toward the image forming path CR1.

Figure 4:
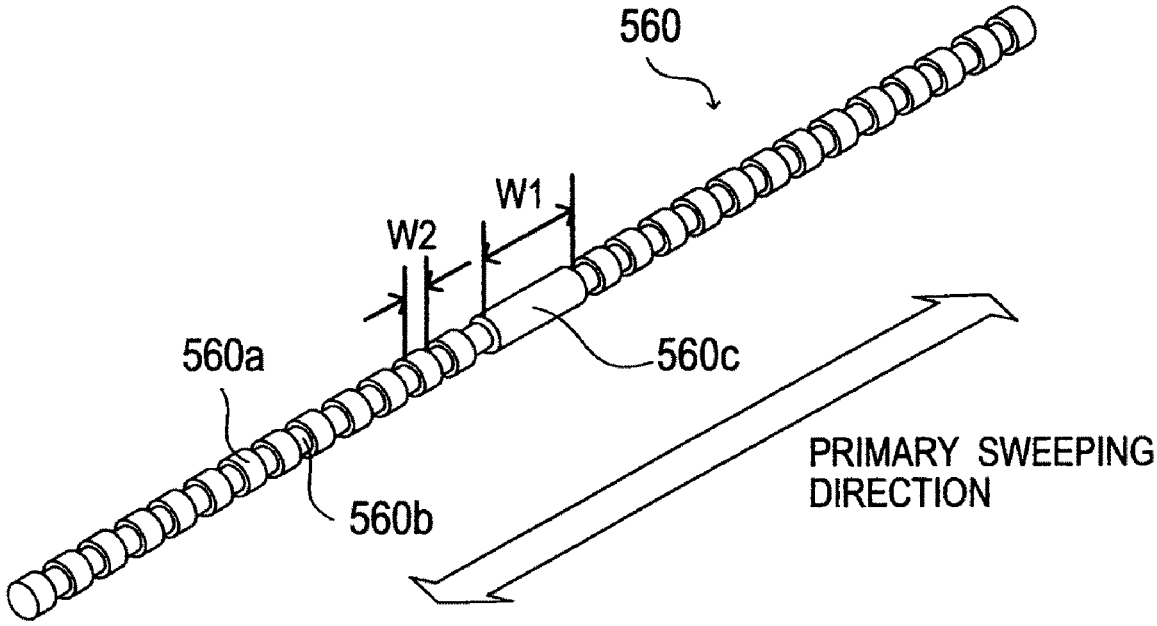
FIG. 4 is a perspective view of a pressure roller in the embodiment.

A pressure roller 560 is provided on the image forming path CR1. FIG. 4 is a perspective view of the pressure roller 560.

The pressure rollers 560 are provided at an upstream portion from the head holder 500 in the feeding direction of the print media, as shown in FIG. 2. The pressure roller 560 rotates with being pressed onto an upper surface of the image forming path CR1. In the present embodiment, the pressure roller 560 is composed of unit rollers 560*a* and 560*c* and coupling rollers 560*b* that are coupled along a primary sweeping direction perpendicular to the feeding direction, as shown in FIG. 4. The coupling rollers 560*b* are interposed between the unit rollers 560*a* and 560*c* to couple the unit rollers 560*a* and 560*c*. Each of the unit rollers 560*a* and 560*c* has a large outer diameter and each of the coupling rollers 560*b* has a small outer diameter. Further, a width W1 of the unit roller 560*c* that positioned at the center in a width direction of the print media is made larger than each width W2 of the unit rollers 560*a* that aligned at both side in the width direction.

Next, an ink mist eduction mechanism on the image forming path CR1 will be explained hereinafter.

Figure 5:
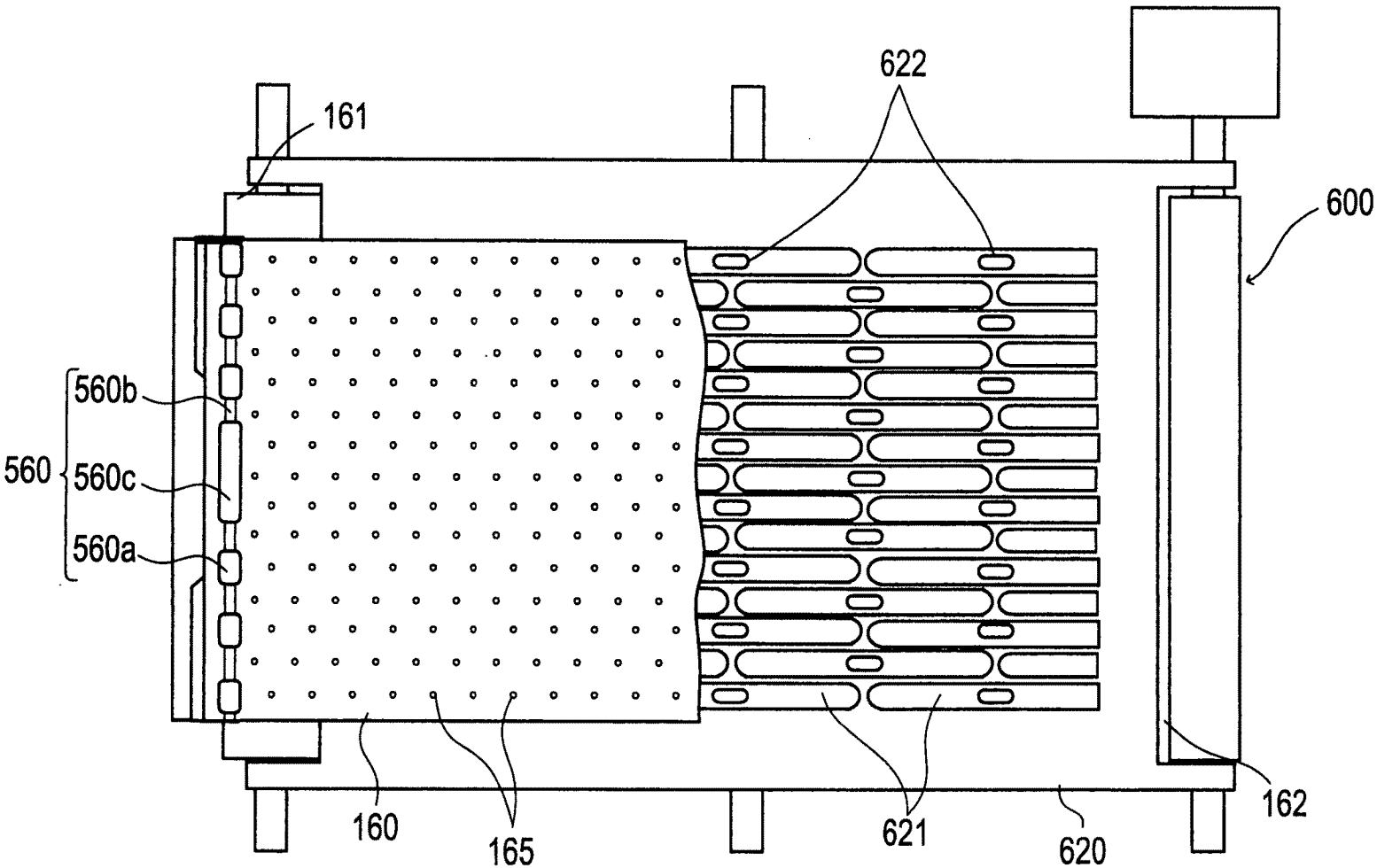
FIG. 5 is a plan view showing the feeding mechanism (partially cut away) in the embodiment.
Figure 6:
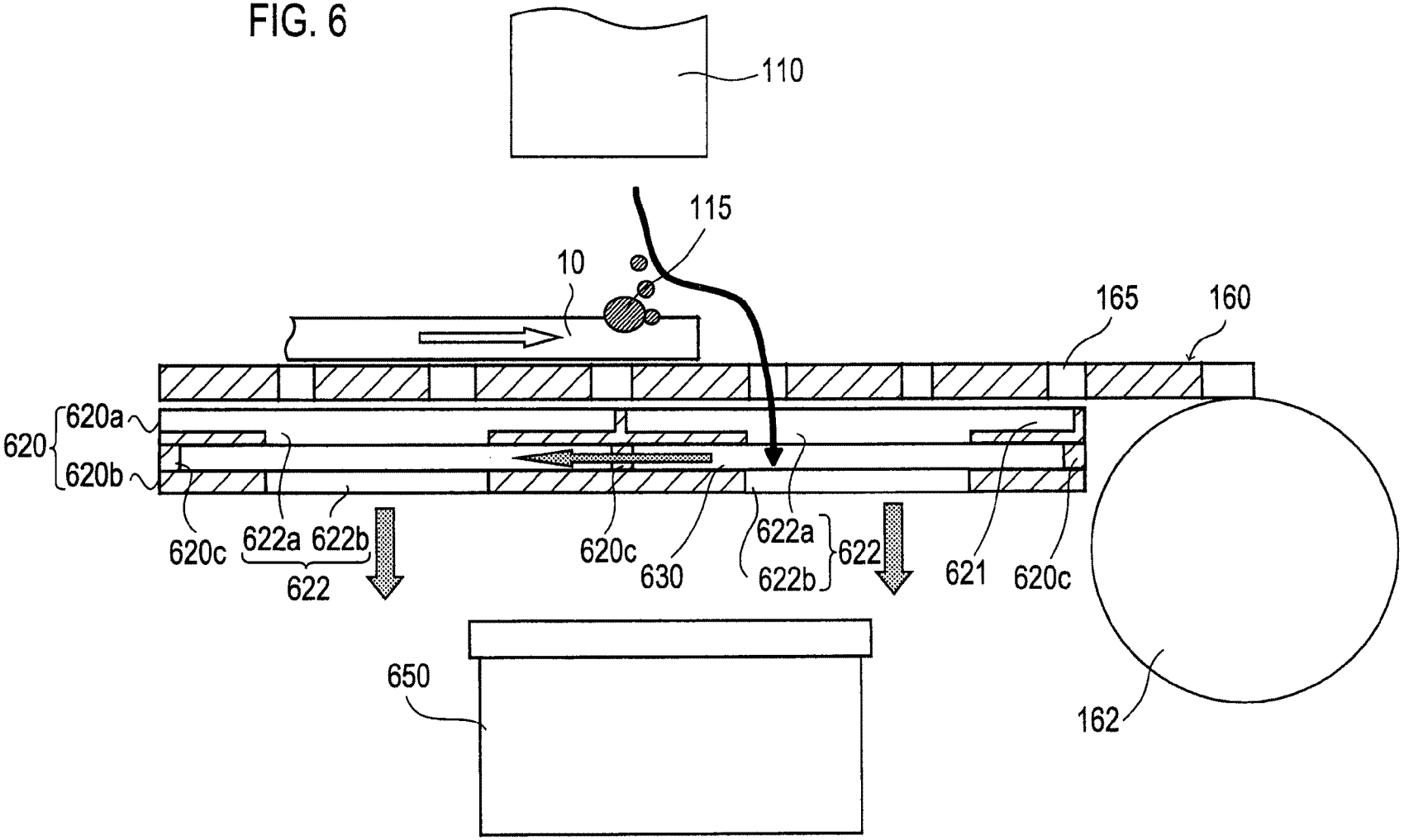
FIG. 6 is a schematic cross-sectional view showing an ink mist eduction mechanism in the embodiment.

As shown in FIGS. 4, 5 and 6, an the image forming path CR1, provided are a platen belt 160 for feeding the print media 10, a platen plate 620 for supporting the platen belt 160, an air amount averaging plate 640 for homogenizing suction pressure at the lower side of the platen plate 620, suction fans (suction units) 650 for generating negative pressure at the lower side of the air amount averaging plate 620, and a chamber partitioner 660 for surrounding a suctioned airflow path from the suction fans 650 to the belt holes 165 under an airtight state.

A number of the belt holes 165 are formed on the platen belt 160 at regular intervals to suction the print media 10. The platen belt 160 is a continuous loop belt member that slides within a range opposing the image forming section to feed the print media 10. The platen belt 160 is supported by the platen plate 620 and placed around a drive roller 161 and a driven roller 162 that are provided along a direction perpendicular to the feeding direction. The platen belt 160 is made rotated by the drive roller 161 to slide in the feeding direction on an upper surface of the platen plate 620.

The platen plate 620 is a plate member and supports the upper segment of the platen belt 160 slidably at the range opposing the ink heads 110*a*. A number of suction holes 622 are formed on the platen plate 620 within ranges where the belt holes 165 pass through (see FIGS. 8A and 8B). The suction fans 650 are provided beneath the platen plate 620 to generate negative pressure for suctioning print media on the upper surface of the platen belt 160 via the suction holes 622 and the belt holes 165.

In addition, each of the suction holes 622 is enlarged toward the upper surface of the platen plate 620 to form a recess 621 on the upper surface of the platen plate 620. The recesses 621 are communicate with the suction holes 622, respectively. In the present embodiment, each of the recesses 621 is formed independently from the adjacent recesses 621 to form a number of segmented tiny spaces on the platen plate 620. These tiny spaces are aligned in a staggered manner not to be coincident with adjacent other tiny spaces in a direction perpendicular to the feeding direction. Although the staggered arrangement is employed not to be coincident in the present embodiment, areas, volumes or locations of the recesses 621 may be varied alternately.

Figure 3:
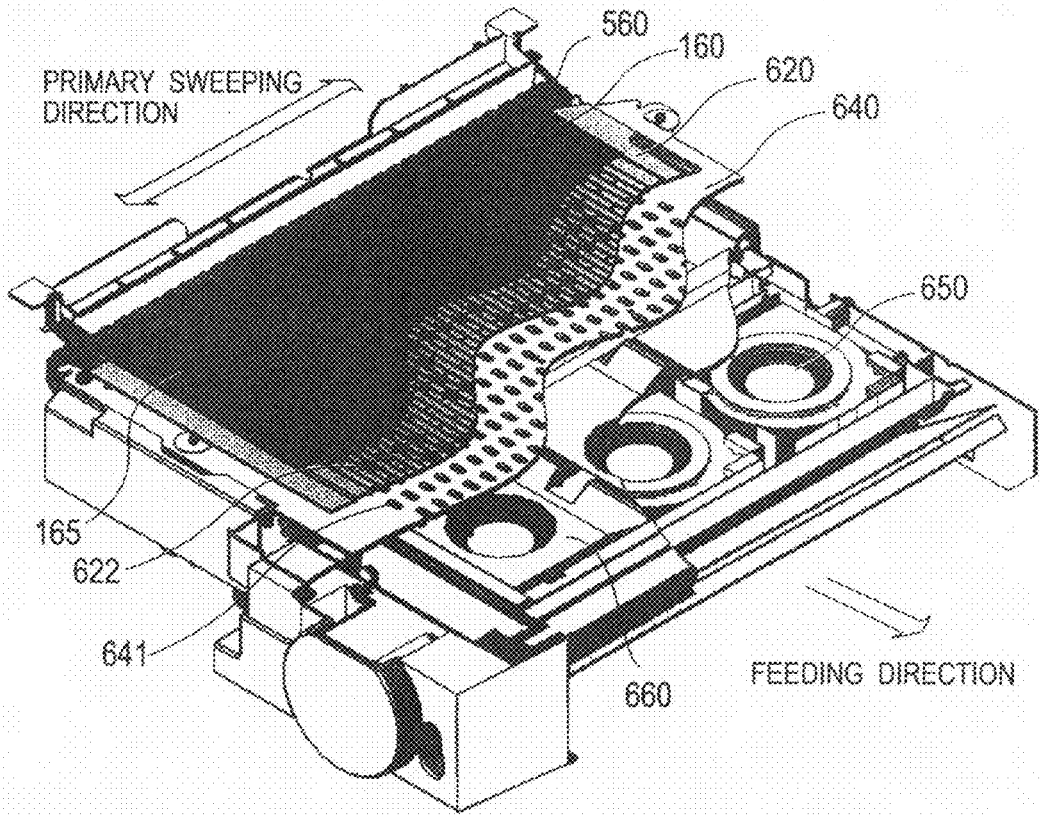
FIG. 3 is a perspective view showing the feeding mechanism (partially cut away) on an image forming path CR1 in the embodiment.

The suction fans 650 are the suction units that generate negative pressure for suctioning print media on the upper surface of the platen belt 160 via the suction holes 622 and the belt holes 165. As shown in FIG. 3, the suction fans 650 are provided beneath the air amount averaging plate 640 in the printer. As shown in FIG. 6, floating ink mists generated from the ink heads 110*a* are educed downward via the belt holes 165 of the platen belt 160 and the suction holes 622 of the platen plate 620 due to the negative pressure generated by the suction fans 650.

The chamber partitioner 660 is a partitioning member that surrounds the suctioned airflow path from the suction fans 650 to the belt holes 165 under an airtight state. As shown in FIG. 2, a cross-sectional trapezoid chamber under the platen plate 620 and above the suction fans 650 is partitioned by the chamber partitioner 660. As shown in FIG. 3, the trapezoid chamber is segmented into three spaces that are aligned along the primary sweeping direction. As shown in FIG. 2, the chamber partitioner 660 includes an inclined wall 660*a* downwardly-inclined at its upstream end. The air amount averaging plate 640 and other components are provided within the chamber.

Figure 9B:
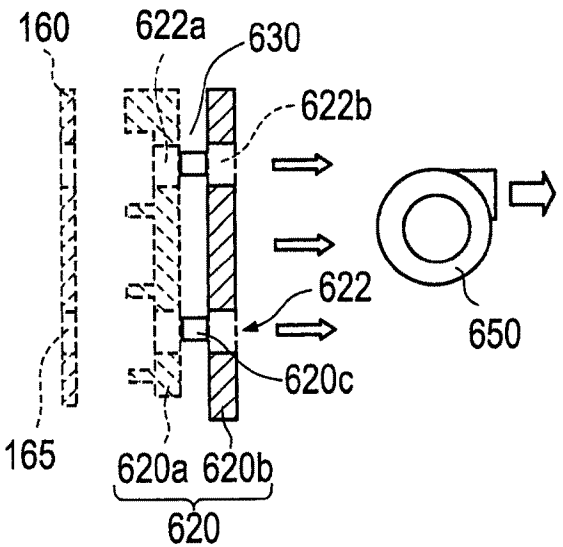
FIG. 9B is a cross-sectional view taken along a line IXB-IXB shown in FIG. 9A.
Figure 9A:
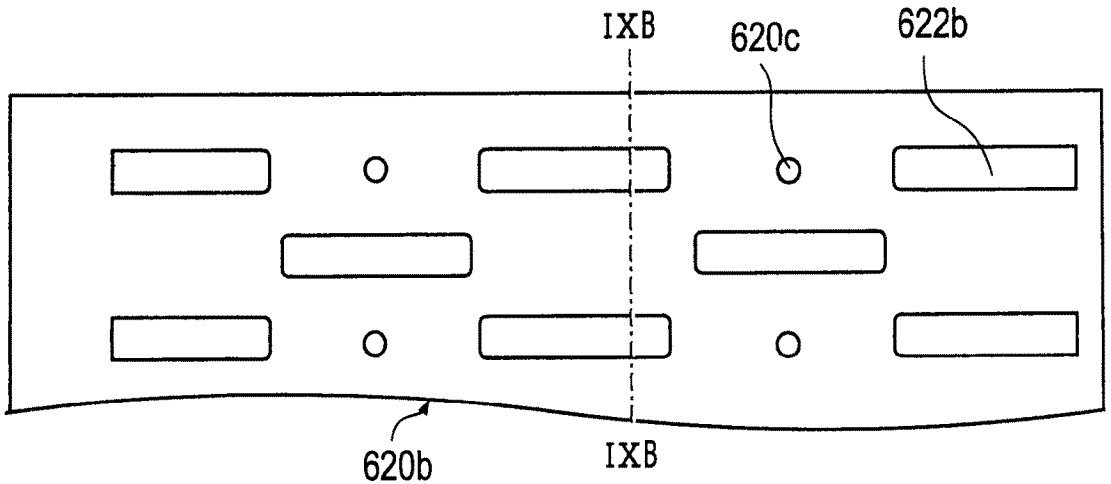
FIG. 9A is a plan view showing a lower platen plate in the embodiment.

The platen plate 620 has a double-layer structure composed of an upper platen plate 620*a* and a lower platen plate 620*b*, as shown in FIG. 6. FIG. 9A shows a plan view of the lower platen plates 620*b* and FIG. 9B shows its cross sectional view taken along IXB-IXB line in FIG. 9A.

As shown in FIGS. 8A and 8B, a large number of upper suction holes 622*a* are formed on the upper platen plate 620*a* at regular intervals within ranges where the belt holes 165 pass through. Each of the upper suction holes 622*a* are enlarged toward the upper surface of the upper platen plate 620*a* to form a number of the recess 621 on the upper surface of the upper platen plate 620*a* at regular intervals. The recesses 621 are communicate with the suction holes 622, respectively.

Each of the recesses 621 is formed independently from the adjacent recesses 621 to form a number of segmented tiny spaces on the upper platen plate 620*a*. Each tiny space is aligned not to be coincident with adjacent other tiny spaces in a direction perpendicular to the feeding direction. In other words, these tiny spaces are aligned in a staggered manner not to be coincident with adjacent other tiny spaces in a direction perpendicular to the feeding direction. Although the staggered arrangement is employed not to be coincident in the present embodiment, areas, volumes or locations of the recesses 621 may be varied alternately.

In addition, each area of the recesses 621 (each opening area of the recesses 621 on an upper plane of the platen plate 620) can include the belt holes 165 that are successively formed in the feeding direction, as shown in FIG. 8A. When the maximum number of the belt holes 165 that can be included in one recess 621 is defined as N, the suction holes 622 (recesses 621) are arranged so that an area of one upper suction hole 622*a* communicating with the one recess 621 is larger than an area N times as large as an area of one belt hole 165. Therefore, air to be suctioned into the recesses 621 can be decentrally suctioned from the side of the ink heads 110*a* via the belt holes 165. In addition, under opening areas of the suction holes 622 as outlet ports from the tiny spaces is made larger than upper opening areas (in the side of the ink heads 110*a*) of the suction holes 622 as inlet ports into the tiny spaces, so that flow speed of air suctioned from the tiny spaces formed by the recesses 621 can be made high.

As shown in FIGS. 9A and 9B, lower suction holes 622*b* are formed on the lower platen plate 620*b* within ranges where the belt holes 165 pass through, similarly to the upper suction holes 622*b* provided on the upper platen plate 620*a*. In addition, spacers 630 are interposed between the upper platen plate 620*a* and the lower platen plate 620*b* to form an inner airflow space 630 by keeping a distance between the upper platen plate 620*a* and the lower platen plate 620*b*. Therefore, mutual airflow among the suction holes 622 can be made via the inner airflow space 630, so that airflow due to the negative pressure by the suction fans 650 is diffused.

Figure 10B:
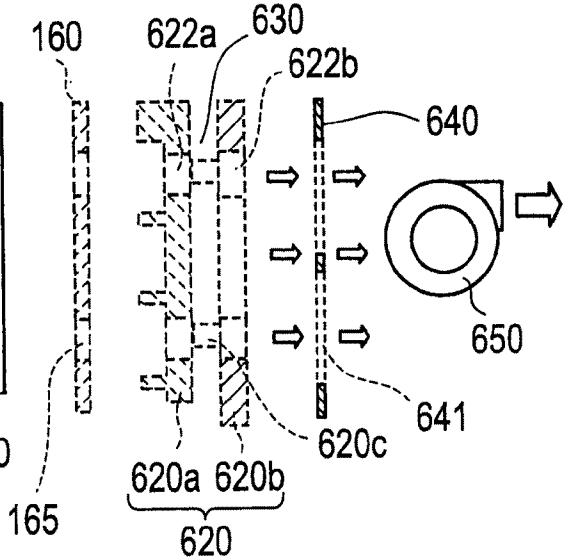
FIG. 10B is a cross-sectional view taken along a line XB-XB shown in FIG. 10A.
Figure 10A:
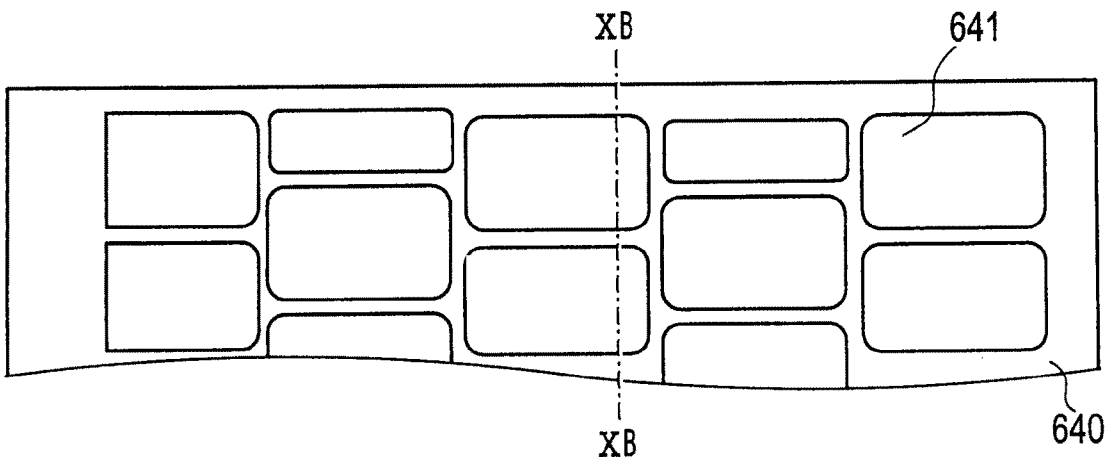
FIG. 10A is a plan view showing an air amount averaging plate in the embodiment.

Further, the grate-like air amount averaging plate 640 is provided between the platen plate 620 and the suction fans 650, in the present embodiment. FIG. 10A shows a plan view of the air amount averaging plate 640 and FIG. 10B shows its cross sectional view taken along XB-XB line in FIG. 10A. As shown in FIGS. 10A and 10B, the air amount averaging plate 640 is a grate-like plate member that homogenizes suction forces by the suction fans 650 applied to the belt holes 165 and the suction holes 622. Grate pattern of the air amount averaging plate 640 can be varied according to arrangements (such as areas and positions) of the recesses 621.

(Pressing Mechanism for Print Media)

As described above, the pressure roller 560 is rotated with being pressed onto the upper surface of the platen belt 160 on the image forming path CR and the chamber partitioner 660 that surrounds the suctioned airflow path from the suction fans 650 to the belt holes 165 under an airtight state is provided beneath the platen belt 160. As above-described with reference to FIG. 2, the chamber partitioner 660 has the downwardly-inclined wall 660*a* and the pressure roller 560 is provided near the upstream end of the inclined wall 660*a*. Therefore, print media are pressed at this portion on the image forming path CR.

Specifically, the inclined wall 660*a* is raised from the side of the suction fans 650 toward the upstream in the feeding direction and the pressure roller 560 is arranged at an extension of the inclined wall 660*a*. Suction forces applied to print media are made gradually stronger from the upstream to the downstream by the inclined wall 660*a*. Since the pressure roller 560 is provided near the upstream end of the inclined wall 660*a* and the width W1 of the center unit roller 560*c* is made large than the width W2 of the unit rollers 560*a* that aligned at both side in the width direction, smoothing wrinkles by the pressure roller 560 is started at a position where suctioning on the platen belt 160 is started.

Figure 11A:
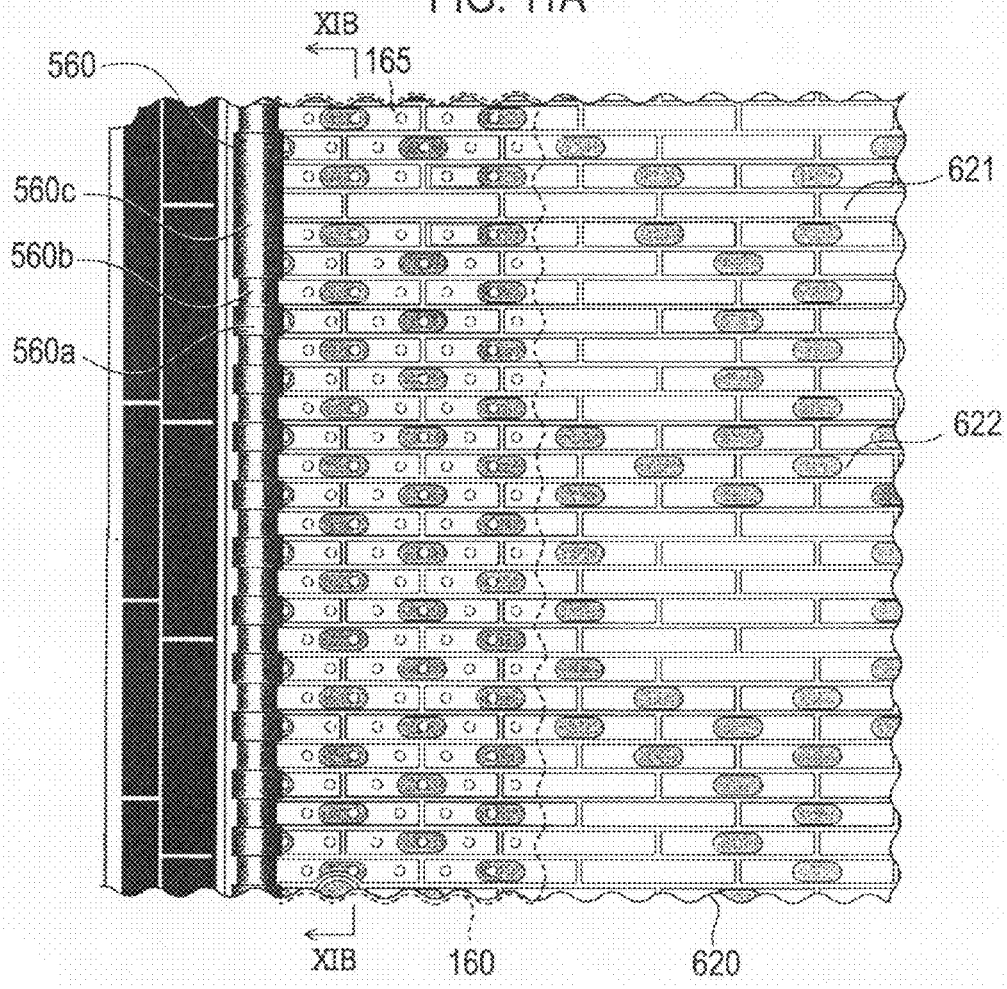
FIG. 11A is a plan view showing positional relationships of unit rollers, belt holes and suction holes.
Figure 11B:
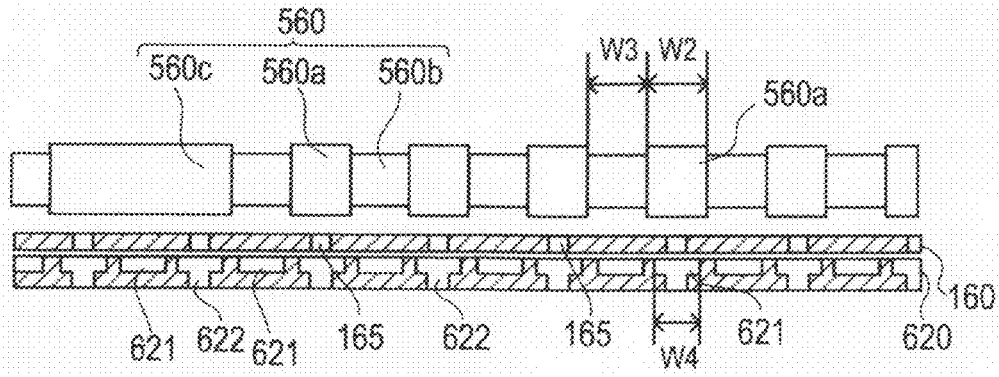
FIG. 11B is a cross-sectional view taken along a line XIB-XIB shown in FIG. 11A.

Further, each of the unit rollers 560*a* composing the pressure roller 560 is located at a position associated with the belt holes 165 and the suction holes 622 in the present embodiment. FIG. 11A is a plan view showing positional relationships of the unit rollers 560*a*, the belt holes 165 and the suction holes 622. FIG. 11B is a cross-sectional view taken along a line XIB-XIB shown in FIG. 11A.

As shown in FIGS. 11A and 11B, the unit rollers 560*a* are located at the positions associated with the belt holes 165 and the suction holes 622. In addition, the width W2 of the unit rollers 560*a* covers a width W4 of the recesses 621. A width W3 between the adjacent two unit rollers 560*a* covers the width W4 of the recesses 621. Therefore, the unit rollers 560*a* are located every other recess 621 with interposing distances therebetween.

(Behaviors and Effects)

According to the present invention as described above, the pressure roller 560 is pressed onto the upper surfaces of the print media on feeding the print media toward the image forming section to restrict uplifts of the print media. Especially, since the unit rollers 560*a* and 560*c* are provided along the primary sweeping direction perpendicular to the feeding direction and the center unit roller 560*c* is made wider than the other unit rollers 560*a*, wrinkles on print media due to uplifts of the print media can be smoothed away so as to extend away the wrinkles from the center of the print media toward both sides of the print media. As a result, cocklings at whole areas of the print media can be prevented.

Further, since the pressure roller 560 is provided near the edge of the inclined wall 660*a* of the chamber partitioner 660, smoothing wrinkles by the pressure roller 560 can be started at the position where suctioning on the platen belt 160 is started. Therefore, cocklings can be surely prevented without applying excessive loads onto the print media.

Furthermore, since the unit rollers 560*a* are located at the positions associated with belt holes 165, pressing by the unit rollers 560*a* and suctioning through the recesses 621 can be done concurrently at the same position. Therefore, uplifts or wrinkles of the print media that could not settled by the unit rollers 560*a* can be surely smoothed by suctioning through the recesses 621, and thereby rumplings of the print media can be completely smoothed away. Since the unit rollers 560*a* are located at the positions associated with the recesses 621, disparity between pressing forces of the unit rollers 560*a* and suction forces through the recesses 621 can be reduced and local loads applying to the print media can be alleviated. As a result, rumplings of the print media can be completely smoothed away.

Especially, since it rollers 560*a* located every other recess 621 with interposing distances therebetween and the recesses 621 are aligned in a staggered manner not to be coincident with adjacent other recesses 621, the disparity between pressing forces of the unit rollers 560*a* and suction forces through the recesses 621 can be reduced more effectively. FIGS. 12A to 14C show transitions of suction forces through the suction holes 622 along with the movement of the print media on the platen belt 160.

Specifically, the platen belt 160 slides on the platen plate 620 to move in the feeding direction. Along with this move of the platen belt 160, the belt holes 165 formed on the platen belt 160 and the print media 10 carried on the platen belt 160 are also moves in the feeding direction. Here, since the print media 10 are suctioned onto the platen belt 160, their relative positions to the belt holes 165 does not change and thereby the print media 10 and the belt holes 165 integrally moves on the platen plate 620. On the other hand, the platen plate 620 is fixed. Since the platen belt 160 moves on the fixed platen plate 620, the relative relationships between the recesses 621 and the suction holes 622 on the platen plate 620 and the holt holes 165 and the print media 10 on the platen belt 165 changes from moment to moment along with the movement of the platen belt 160. FIGS. 12A to 14C show this change (transition) of the relative relationships in chronological order.

Figures 12A, 12B, 12C:
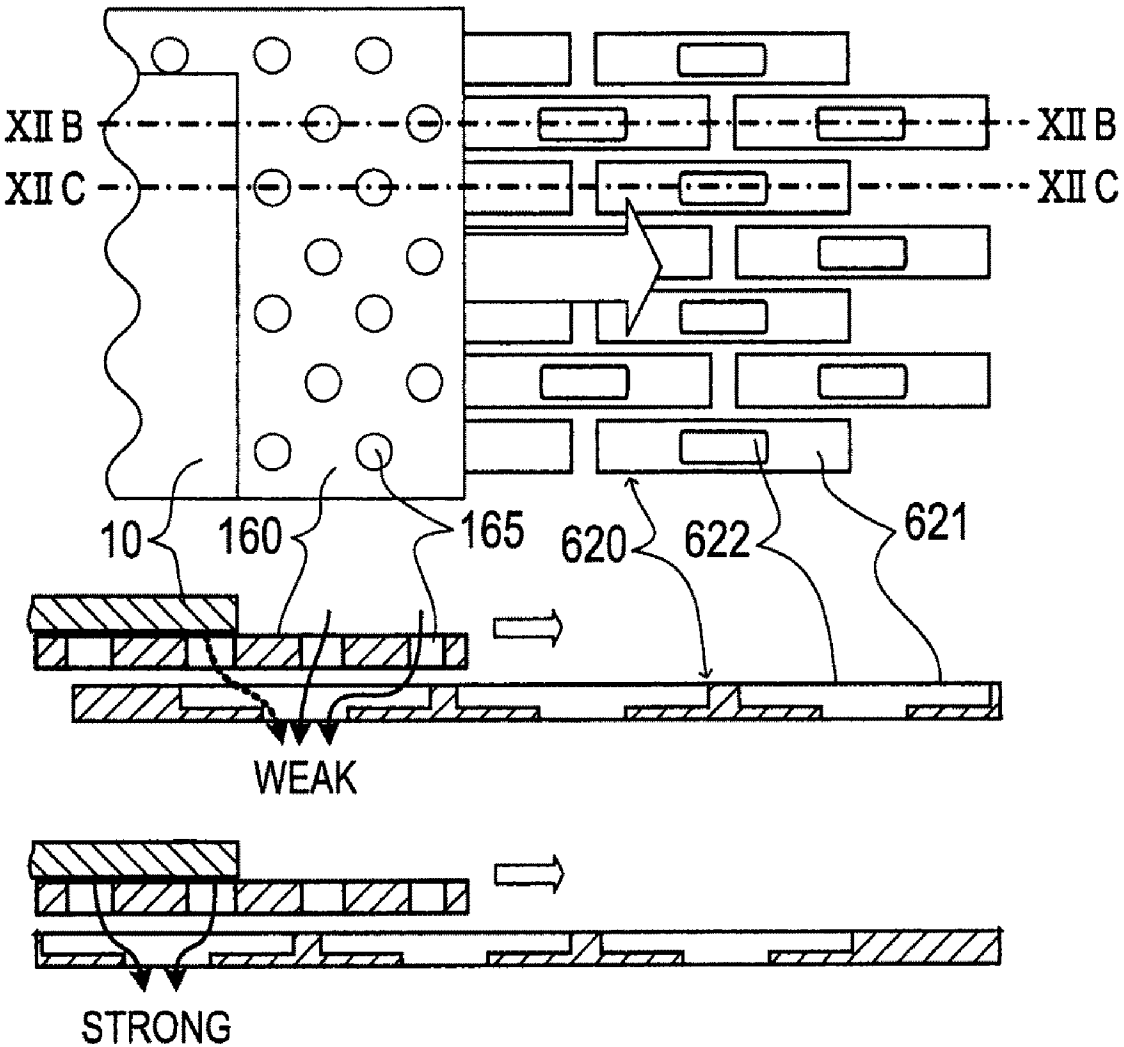
FIG. 12A is a plan view for explaining transition of suction forces along with movement of a print medium (first state)
FIG. 12B is a cross-sectional view taken along a line XIIB-XIIB shown in FIG. 12A.
FIG. 12C is a cross-sectional view taken along a line XIIC-XIIC shown in FIG. 12A.

FIGS. 12A to 12C show a state where a leading edge of a print medium 10 just arrives an upstream edge of the recess 621 shown at the leftmost in FIG. 12B. As shown in FIG. 12B (a cross-sectional view taken along a line XIIB-XIIB shown in FIG. 12A), three of the belt holes 165 are located within one recess 621, and one of the three is closed by the print medium 10. Since there are two unclosed belt holes 165 among the three, suctioned airflow is slow and negative pressure (suction force) applying to the closed belt hole 165 beneath the print medium 10 is weak. On the other hand as shown in FIG. 12C (a cross-sectional view taken along a line XIIC-XIIC adjacent to the line XIIB-XIIB), all of the belt holes 165 within another recess 621 are closed, and thereby maximum suction pressure through the other recess 621 applies to the print medium 10.

Figures 13A, 13B, 13C:
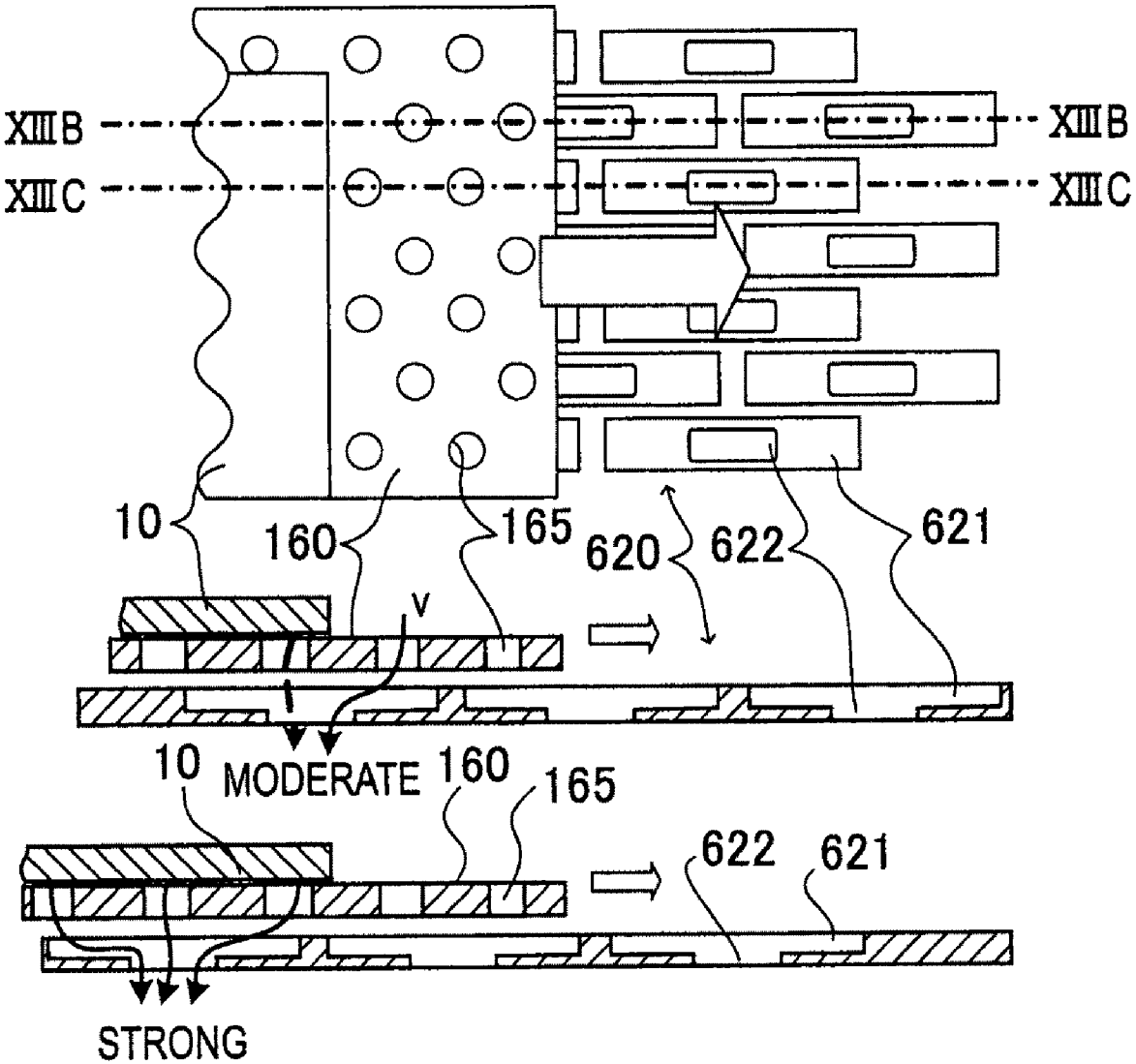
FIG. 13A is a plan view for explaining the transition of suction forces (second state)
FIG. 13B is a cross-sectional view taken along a line XIIIB-XIIIB shown in FIG. 13A.
FIG. 13C is a cross-sectional view taken along a line XIIIC-XIIIC shown in FIG. 13A.

Subsequently as shown in FIGS. 13A and 13B, the belt holes 165 within the one recess 621 reduces to two along a line XIIIB-XIIIB (identical to the line XIIB-XIIB) due to the movement of the platen belt 160, and one of the two is closed by the print medium 10. Therefore, there is one unclosed belt hole 165 among the two. Since a flow speed is in inverse proportion to a cross-sectional area, the flow rate v becomes large along with the decrease of the cross-sectional areas of the belt holes 165. Since the negative pressure due to the flow rate is inverse proportion to the flow rate v squared, the flow rate v becomes gradually large and the negative pressure applying to the print medium 10 also becomes gradually large as the area of the unclosed belt holes 165 decreases along with its move out of the one recess 621. On the other hand as shown in FIG. 13C, all of the belt holes 165 within the other recess 621 stay closed along a line XIIIC-XIIIC (identical to the line XIIC-XIIC) and the maximum suction pressure through the other recess 621 still applies to the print medium 10.

Figures 14A, 14B, 14C:
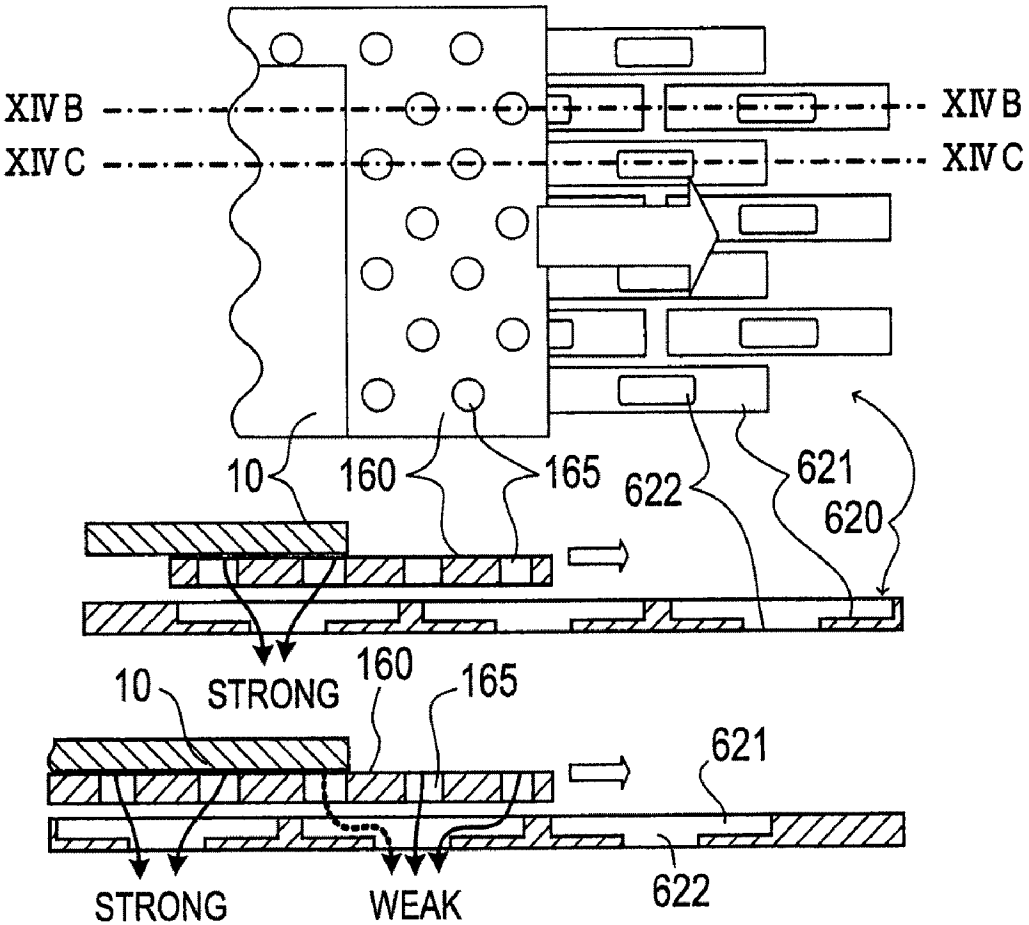
FIG. 14A is a plan view for explaining the transition of suction forces (third state)
FIG. 14B is a cross-sectional view taken along a line XIVB-XIVB shown in FIG. 14A.
FIG. 14C is a cross-sectional view taken along a line XIVC-XIVC shown in FIG. 14A.

Subsequently as shown in FIGS. 14A and 14B, the belt holes 165 within the one recess 621 are two along a line XIVB-XIVB (identical to the line XIIB-XIIB), but all of the two is closed by the print medium 10 due to the movement of the platen belt 160. Therefore, the maximum suction pressure through the one recess 621 applies to the print medium 10. On the other hand as shown in FIG. 14C, the leading edge of the print medium 10 just reaches at a next recess 621. Then, there are three of the belt holes 165 within the next recess 621, and one of the three is closed by the print medium 10. Since there are two unclosed belt holes 165 among the three, suctioned airflow is slow and negative pressure (suction force) applying to the closed belt hole 165 beneath the print medium 10 is weak.

According to the arrangement of the recesses 621 staggered manner as described above, since the number (i.e., the area) of the belt holes 165 within a single recess 621 varies along with the movement of the platen belt 160, the suction force through the single recess 621 can be varied with time lag due to this variation. In other words, suction forces applying to the adjacent recesses 621 are made alternately strong or weak. As a result, suction airflow amount at a leading edge of a print medium is made decentral and local increase of the airflow is prevented. Therefore, pulsation of the suction forces can be restricted.

Especially, the suction forces applying to the adjacent recesses 621 are not made strong or weak at the same time, but made alternately strong or weak with time lag. In addition, the unit rollers 560*a* are located at the positions associated with the recesses 621 and located every other recess 621 with interposing distances therebetween. As a result, suctioned airflow amounts through the adjacent recesses 621 are made decentral and local increase of the airflow is prevented. Therefore, wrinkles on print media can be smoothed by the unit rollers 560*a* and flattening of print media can be achieved surely.

According to the present embodiment, cocklings on print media can be restricted with a simple configuration and wet cocklings on print media can be removed at desired portions by controlling suction forces due to varying relative positions to suction ports. Therefore, a flat state of print media just beneath the ink heads 110*a* can be easily ensured.

Modification Example

Figure 15:
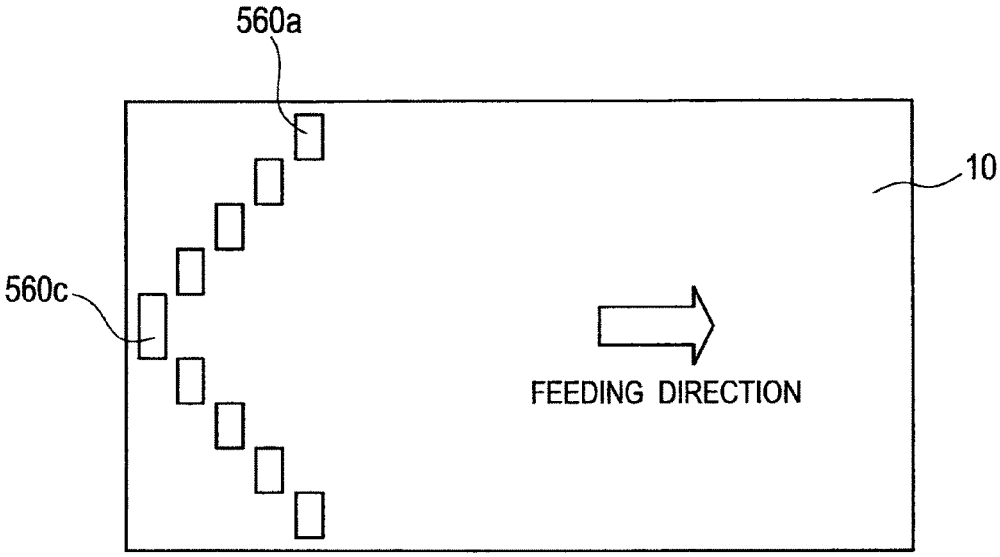
FIG. 15 is a plan view showing another example of the pressure roller.

Although the pressure roller 560 in the above embodiment is, as shown in FIG. 4, configured by coupling the unit rollers 560*a* in line, its is not limited to the configuration and may take various configurations within the scope of the present invention. For example, the unit rollers 560*a* may be separated independently and aligned in a V-shape arrangement that is opened toward the downstream of the feeding direction, as shown in FIG. 15.

In such a case where the pressure roller 560 is configured by aligning the unit rollers 560*a* in a V-shape arrangement that is opened toward the downstream of the feeding direction, pressing of a print medium by the unit rollers 560*a* is started at the center of the print medium on the upstream side of the image forming section. Then, its pressed portions are gradually shifted toward its both sides along it is fed downstream. Therefore, cocklings, wrinkles, rumplings or the like on the print medium can be surely smoothed away toward its both sides.

In the above case with the V-shape arrangement of the unit rollers 560*a*, since the pressure roller 560 is located near the edge of the inclined wall 660*a* of the chamber partitioner 660, smoothing toward the both sides of the print media can be made gradually alleviated along with gradual increase of the suction forces from the upstream to the downstream due to the inclined wall 660*a*. Therefore, pressing forces by the unit rollers and the suction forces by the suction unit(s) can be well-balanced. As a result, removing of cocklings can be averaged throughout from the upstream to the downstream.

What is claimed is:

1. A feeding apparatus for print media in a printer, which forms images at an image forming section by injecting inks on the print media being fed on a feeding path, the apparatus comprising:

a pressure roller that is provided at an upstream side of the image forming section in a feeding direction of the print media and rotates with being pressed onto an upper surface of the feeding path;

a platen belt configured to slide within a range opposing the image forming section to feed the print media;

a plurality of belt holes formed on the platen belt and configured for suctioning the print media therethrough;

a platen plate configured to slidably support an upper segment of the platen belt at the range opposing the image forming section; and a plurality of suction holes formed on the platen plate at positions associated with the belt holes, wherein the pressure roller includes a plurality of unit rollers aligned along a primary sweeping direction perpendicular to the feeding direction, the unit rollers are located at positions associated with the belt holes, the suction holes are enlarged toward an upper surface of the platen plate to form recesses, the unit rollers are located at positions associated with the recesses, a center unit roller of the unit rollers is wider in the primary sweeping direction than other unit rollers, the other unit rollers are wider in the primary sweeping direction than in the recesses, and distances between adjacent two of the other unit rollers are wider in the primary sweeping direction than in the recesses.

2. The feeding apparatus according to claim 1, wherein the plurality of unit rollers is aligned in a V-shape arrangement that is opened toward a downstream of the feeding direction.

3. The feeding apparatus according to claim 1, further comprising:

a suction unit configured to generate negative pressure to suction the print media on the upper surface of the platen belt through the belt holes; and a chamber partitioner for surrounding a suctioned airflow path from the suction unit to the belt holes under an airtight state, wherein the chamber partitioner includes an inclined wall downwardly-inclined at an upstream end thereof, and the pressure roller is located near the upstream end of the inclined wall.

4. The feeding apparatus according to claim 1, wherein the unit rollers are located at every other recess with interposing distances therebetween; and the unit rollers are aligned in a staggered manner not to be coincident with adjacent other recesses.

* * * * *